US007562552B2

(12) United States Patent
College

(10) Patent No.: US 7,562,552 B2
(45) Date of Patent: Jul. 21, 2009

(54) CRIMP HEIGHT ADJUSTMENT MECHANISM

(75) Inventor: David Alan College, Annville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 677 days.

(21) Appl. No.: 11/271,640

(22) Filed: Nov. 10, 2005

(65) Prior Publication Data

US 2007/0101799 A1 May 10, 2007

(51) Int. Cl.
*B21J 13/02* (2006.01)
*H01R 43/04* (2006.01)

(52) U.S. Cl. ..... 72/446; 72/482.8; 29/752; 29/753; 100/48; 100/99

(58) Field of Classification Search ..... 72/441, 72/446, 448, 482, 482.8; 29/750–754; 100/48, 100/99, 271

See application file for complete search history.

(56) References Cited

U.S. PATENT DOCUMENTS 4,576,032 A * 3/1986 Maack et al. ..... 72/466.3
5,175,925 A * 1/1993 Grosklos et al. ..... 29/753
5,228,326 A 7/1993 Wasilko et al.
5,253,572 A * 10/1993 Uehara et al. ..... 100/48
5,408,860 A 4/1995 Bair et al.
5,443,549 A * 8/1995 Mimuro et al. ..... 72/441
5,666,850 A 9/1997 Yanagisawa et al.
5,845,528 A 12/1998 Wollermann
5,909,913 A * 6/1999 Fitz et al. ..... 29/753
6,026,562 A * 2/2000 McMillin et al. ..... 29/753
6,212,924 B1 * 4/2001 Meisser ..... 72/21.4
6,418,768 B2 7/2002 Meisser et al.
6,487,885 B2 12/2002 Meisser et al.
6,505,494 B1 * 1/2003 Wollermann ..... 72/31.1
2002/0050159 A1 5/2002 Meisser et al.

OTHER PUBLICATIONS

European Search Report; Application No. EP 06 12 3407, Apr. 29, 2009.

* cited by examiner

*Primary Examiner*—David B Jones

(57) ABSTRACT

A terminator assembly for a terminal crimping machine includes a drive member and a first ram member coupled to the drive member. The drive member moves the first ram member in a first direction toward a crimping zone of the terminal crimping machine, and a second direction away from the crimping zone of the terminal crimping machine. The terminator assembly also includes a second ram member movable with respect to the first ram member to control the crimp height of the terminal crimping machine. The second ram member includes a base portion configured to engage at least one of an applicator assembly and crimp-tooling. An adjusting mechanism is coupled to each of the first and second ram members. The adjusting mechanism is configured to adjust a relative position of the first ram member with respect to the second ram member. A motor is operatively coupled to a drive shaft, and the drive shaft engages the adjusting mechanism for driving the adjusting mechanism.

20 Claims, 5 Drawing Sheets

CRIMP HEIGHT ADJUSTMENT MECHANISM

BACKGROUND OF THE INVENTION

This invention relates generally to machines for crimping electrical terminals to conductors of a wire, and, more particularly, to crimp height adjustment mechanisms for a terminal crimping machine.

Terminal crimping machines have long been used in the connector industry to effect high-speed mass termination of various cables. It is common practice for the crimping machine to have an interchangeable tooling assembly called an applicator, and a powered mechanism called a terminator. In general, such terminators include a terminator ram which is driven by an electric motor or other power source. The applicator may include upper and lower forming tooling and feed tracks for guiding a continuous supply of terminals. The terminator ram is coupled to an applicator ram which holds a crimping tool-head. The attached tool-head is driven by the rams into proximity with a continuous strip of terminal(s) to be crimped. Many conventional terminators are of a push link or roller design wherein a crank pin is coupled to the terminator ram. The crank pin compels the ram downwardly during a 180 degree portion of its orbit to advance the rams and crimping tool-head toward an anvil of the applicator. The terminal(s) are formed by the anvil and the tool-head.

However, these known crimping terminators do not allow convenient adjustment of the crimp height to compensate for such things as tooling wear, dimensional tolerances of replacement parts, and dimensional changes due to temperature variations. Typically, a manual crimp height adjustment mechanism is provided, such as, for example, a dial wheel, which adjusts a position of the crimp tooling or the crank pin. Other crimp height adjustment mechanisms have adjusted a height of the anvil. However, if the terminator is mounted on automatic wire processing equipment, moving the anvil may affect other settings of the equipment, such as the wire presentation height to the continuous-feed applicator.

BRIEF DESCRIPTION OF THE INVENTION

In one aspect, a terminator assembly for a terminal crimping machine is provided including a drive member. A first ram member is coupled to the drive member, and the drive member moves the first ram member in a first direction toward a crimping zone of the terminal crimping machine, and a second direction away from the crimping zone of the terminal crimping machine. The terminator assembly also includes a second ram member movable with respect to the first ram member to control the crimp height of the terminal crimping machine. The second ram member includes a base portion configured to configured to engage at least one of an applicator assembly and crimp-tooling. An adjusting mechanism is coupled to each of the first and second ram members. The adjusting mechanism is configured to adjust a relative position of the first ram member with respect to the second ram member. A motor is operatively coupled to a drive shaft, and the drive shaft engages the adjusting mechanism for driving the adjusting mechanism.

Optionally, the second ram member may include a second ram member cavity, and the first ram member may be received within the second ram member cavity. The adjusting mechanism may include a threaded portion which engages at least one of the first and second ram members, wherein rotational movement of the adjusting mechanism changes the relative position of the first ram member with respect to the second ram member. Optionally, the adjusting mechanism may be operatively coupled to a motor for driving the adjusting mechanism. In one embodiment, the drive member may be coupled to a crank shaft. Optionally, the drive member may be off-set with respect to an axis of rotation of the crank shaft, wherein the drive member orbits the axis of rotation during rotation of the crank shaft.

In another aspect, a terminator assembly for a terminal crimping machine is provided including a drive member. A first ram member is coupled to the drive member, and the drive member moves the first ram member in a first direction toward a crimping zone of the terminal crimping machine, and a second direction away from the crimping zone of the terminal crimping machine. The terminator assembly also includes a second ram member having a second ram member cavity, wherein the first ram member is received within the second ram member cavity. The second ram member is movable with respect to the first ram member to control the crimp height of the terminal crimping machine. The second ram member includes a base portion configured to engage at least one of an applicator assembly and crimp-tooling. An adjusting mechanism is coupled to each of the first and second ram members. The adjusting mechanism is configured to adjust a relative position of the first ram member with respect to the second ram member.

In a further aspect, a crimp height adjustment assembly is provided for adjusting a crimp height of a terminal crimping machine. The crimp height adjustment assembly includes a first ram member configured to be coupled to a drive member of the terminal crimping machine. The drive member moves the first ram member in a first direction toward a crimping zone of the terminal crimping machine, and a second direction away from the crimping zone of the terminal crimping machine. The crimp height adjustment assembly also includes a second ram member movable with respect to the first ram member to control the crimp height of the terminal crimping machine. The second ram member includes a base portion configured to engage at least one of an applicator assembly and crimp-tooling. An adjusting mechanism is coupled to each of the first and second ram members, and the adjusting mechanism is configured to adjust a relative position of the first ram member with respect to the second ram member. A motor is operatively coupled to a drive shaft, and the drive shaft engages the adjusting mechanism for driving the adjusting mechanism.

DETAILED DESCRIPTION OF THE INVENTION

Figure 1:
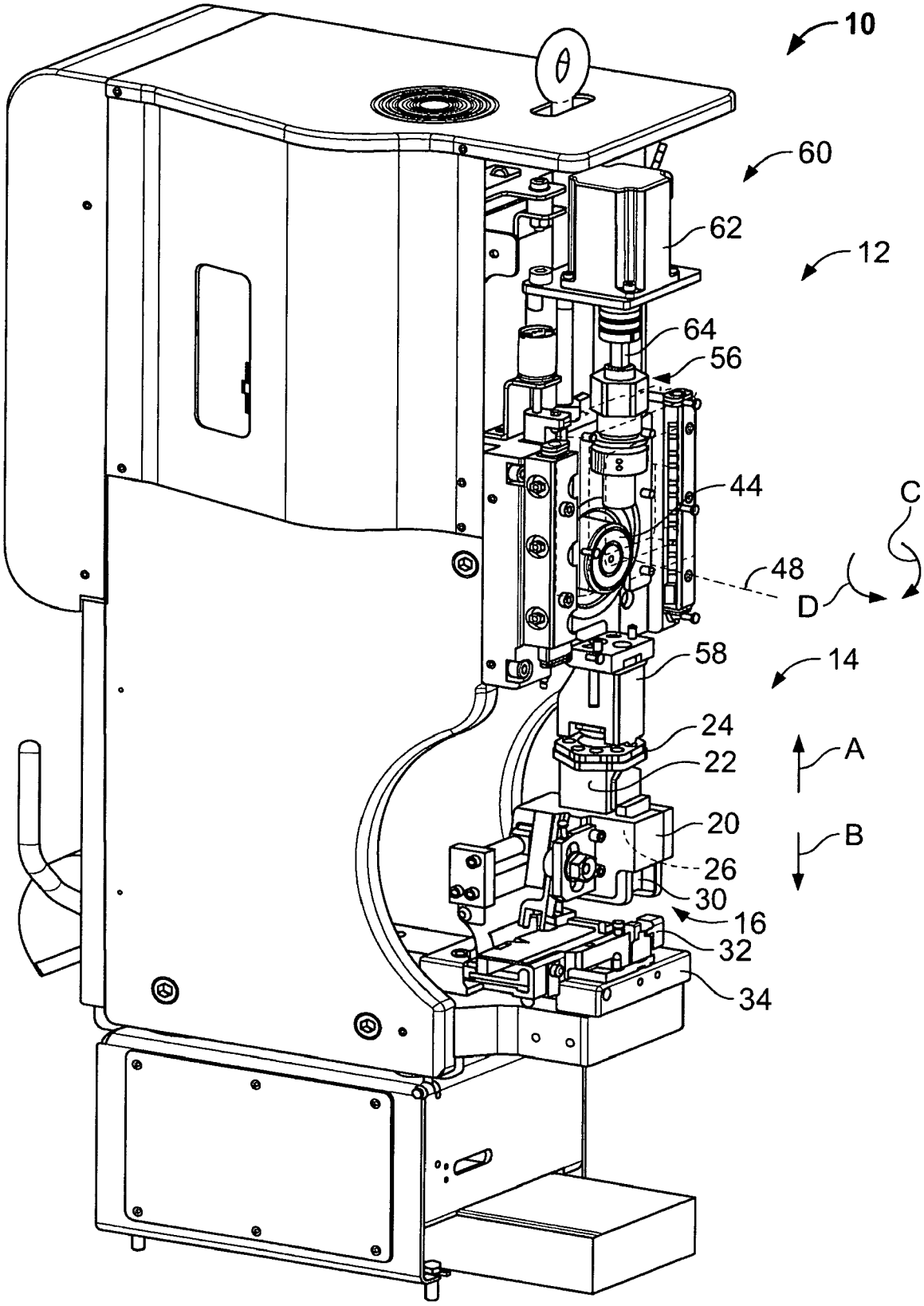
FIG. 1 is a perspective view of an exemplary terminal crimping machine having a terminator assembly and an applicator assembly.
Figure 2:
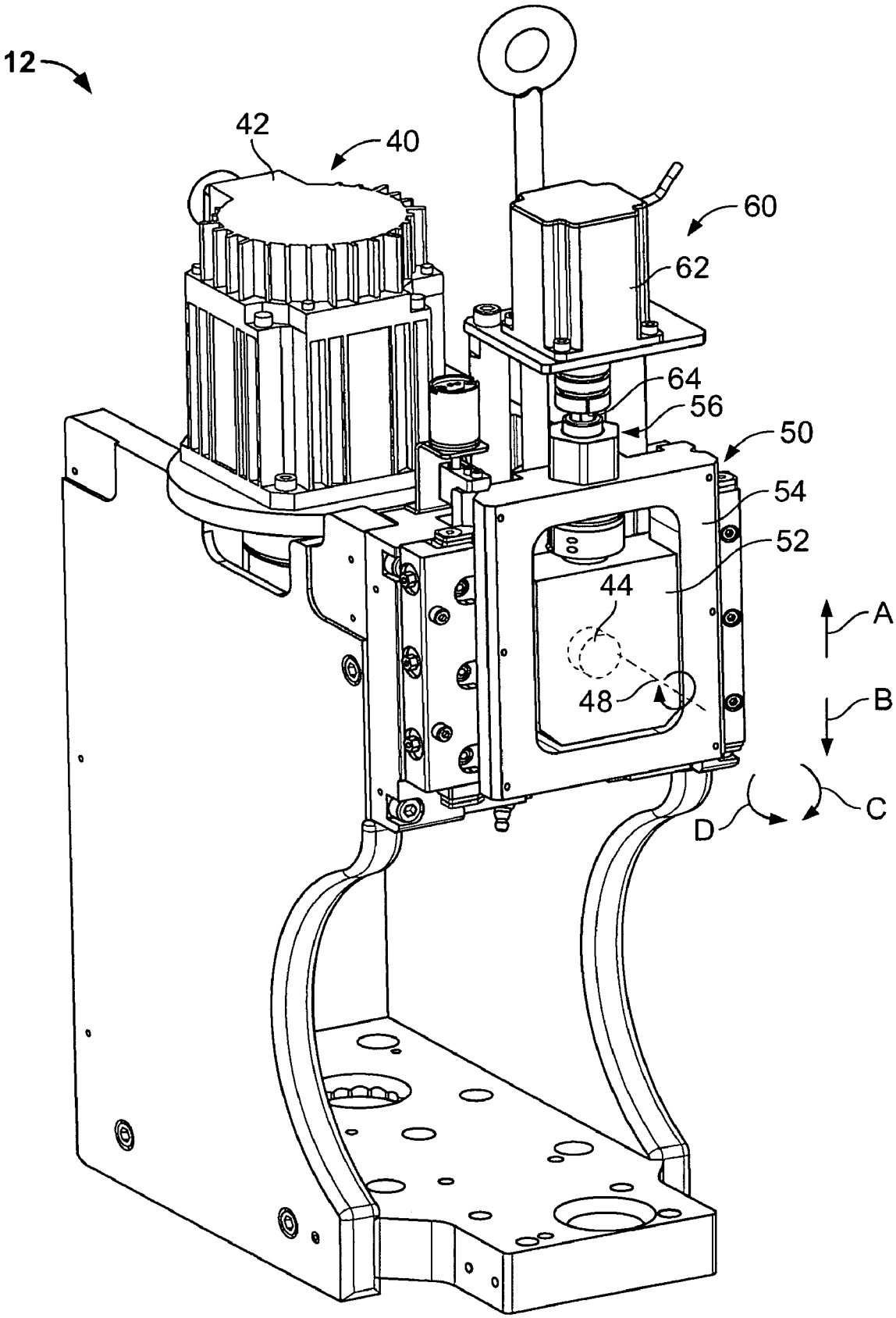
FIG. 2 is a perspective view of the terminator assembly shown in FIG. 1.

FIG. 1 is a perspective view of a terminal crimping machine 10 having a terminator assembly 12 and an applicator assembly 14. A portion of the terminator assembly 12, a ram assembly 50, is removed for clarity. FIG. 2 is a perspective view of the terminator assembly 12, showing the ram assembly 50. The terminal crimping machine 10 is used to crimp a terminal (not shown) to a wire (not shown) at a crimping zone 16 of the terminal crimping machine 10.

As illustrated in FIG. 1, the applicator assembly 14 includes an applicator housing 20 and an applicator ram 22 received within the applicator housing 20. The applicator ram 22 extends between a first end 24 and a second end 26. Optionally, the applicator ram 22 may be a square shaft such that rotation within the applicator housing 20 is limited. The applicator ram 22 is moveable in a first direction away from the crimping zone 16, such as in the direction of arrow A, and a second direction toward the crimping zone 16, such as in the direction of arrow B.

Crimp tooling 30 is coupled to the second end 26 of the applicator ram 22. The crimp tooling 30 has a predefined shape to facilitate crimping the terminal to the wire. The applicator assembly 14 also includes an anvil 32 positioned within the crimping zone 16. The anvil 32 may be securely mounted to a platform 34 fixed within the terminal crimping machine 10. The anvil 32 has a predefined shape to facilitate crimping the terminal to the wire. In operation, as the applicator ram 22 is driven in the second direction toward the crimping zone 16, the crimp tooling 30 is also driven toward the crimping zone 16. At a drive limit, the crimp tooling 30 is positioned a distance from the anvil 32 defining a crimp height of the terminal crimping machine 10. The crimp height may be adjusted by changing the distance between the anvil 32 and the crimp tooling 30.

The terminator assembly 12 includes a terminator terminator drive system 40 for the terminal crimping machine 10. The terminator drive system 40 has a motor 42 (FIG. 2) for driving a drive member 44. During operation of the terminal crimping machine 10, the drive member 44 is moved along a repeated predetermined path. Movement along the predetermined path from a starting position to an ending position is referred to as a stroke. Optionally, the starting and ending positions for each stroke is the same position. In one embodiment, the drive member 44 has a circular or pivotal range of motion. For example, the drive member 44 may be coupled to a crank shaft 46 (shown in FIG. 3) that rotates about an axis of rotation 48. The drive member 44 is coupled to the crank shaft 46 such that a center point of the drive member 44 is off-set with respect to the axis of rotation 48. As such, the drive member 44 orbits the axis of rotation 48 in a clockwise direction, such as in the direction of arrow C, or a counterclockwise direction, such as in the direction of arrow D. As the drive member 44 orbits, the drive member 44 has both horizontal and vertical components. The vertical components of the orbit correspond to movement in either a first direction away from the crimping zone 16, such as in the direction of arrow A, or a second direction toward the crimping zone 16, such as in the direction of arrow B. Optionally, the drive member 44 is a roller element. Alternatively, the drive member 44 may be a pin element or a link element. In alternative embodiments, the drive member 44 may have a linear or reciprocating range of motion, rather than a circular range of motion. In these alternative embodiments, the drive member 44 is moved linearly in a first direction away from the crimping zone 16, such as in the direction of arrow A, and a second direction toward the crimping zone 16, such as in the direction of arrow B.

As illustrated in FIG. 2, the terminator assembly 12 includes a ram assembly 50 having a first or inner ram member 52 and a second or outer ram member 54. The inner ram member 52 and the outer ram member 54 are coupled to one another by an adjusting mechanism 56. The ram assembly 50 is operationally engaged with the drive member 44, which is shown in phantom in FIG. 2. The ram assembly 50 is movable in a first direction away from the crimping zone 16, such as in the direction of arrow A, and a second direction toward the crimping zone 16, such as in the direction of arrow B. For example, the vertical components of the drive member 44 orbit is transferred to the ram assembly 50 to move the ram assembly 50. Optionally, the applicator ram 22 (FIG. 1) may be coupled to the outer ram member 54. As such, movement of the outer ram member 54 also adjusts the position of the applicator ram 22 and the crimp tooling 30. In one embodiment, the applicator ram 22 and the outer ram member 54 are coupled to one another by an adapter 58 (FIG. 1).

The terminator assembly 12 includes a crimp height adjustment assembly 60. In one embodiment, the crimp height adjustment assembly 60 includes the adjusting mechanism 56, a crimp height drive system such as, for example, an adjustment assembly motor 62, and an adjusting mechanism drive shaft 64 extending between the adjustment assembly motor 62 and the adjusting mechanism 56. Optionally, the adjustment assembly motor 62 may be a stepper motor or a servo motor. In operation, the crimp height of the terminal crimping machine 10 may be adjusted by adjusting the relative positions of the inner ram member 52 with respect to the outer ram member 54. The crimp height adjustment assembly 60 may be operated independently with respect to the terminator drive system 40 to adjust the crimp height. The adjustment assembly motor 62 rotates the adjusting mechanism drive shaft 64, and the rotation of the adjusting mechanism drive shaft 64 is transferred to the adjusting mechanism 56. Rotational movement of the adjusting mechanism 56 changes the relative position of the inner ram member 52 with respect to the outer ram member 54. For example, the outer ram member 54 may be moved in a first direction with respect to the inner ram member 52 away from the crimping zone 16, such as in the direction of arrow A. Alternatively, the outer ram member 54 may be moved in a second direction with respect to the inner ram member 52 toward the crimping zone 16, such as in the direction of arrow B.

Figure 3:
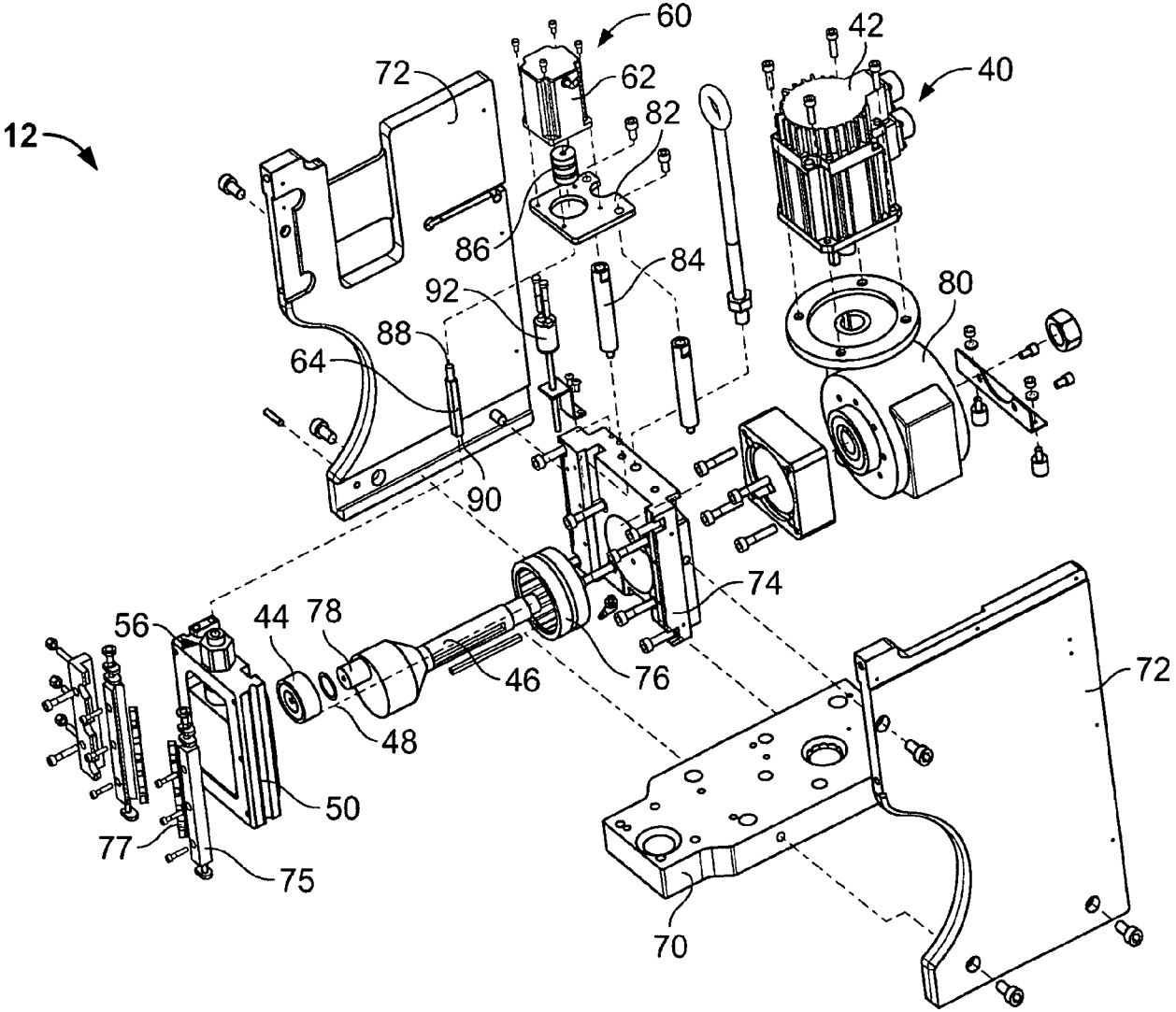
FIG. 3 is an exploded perspective view of the terminator assembly shown in FIG. 1.

FIG. 3 is an exploded perspective view of the terminator assembly 12. The terminator assembly 12 includes a base portion 70 and side plates 72 for supporting the components of the terminator assembly 12. A front plate 74 is secured between the side plates 72 and supports the crank shaft 46 of the terminator drive system 40 and the ram assembly 50. Optionally, rails 75 are used to capture and guide the ram assembly 50 with respect to the front plate 74. The ram assembly 50 is movable with respect to the rails 75. Optionally, caged rollers 77 are provided to reduce friction between the ram assembly 50 and the rails 75. When assembled, the ram assembly 50 is coupled to the drive member 44 of the terminator drive system 40.

A bearing 76 is positioned between the front plate 74 and the crank shaft 46 to facilitate rotation of the crank shaft 46. The crank shaft 46 includes a projection 78 extending therefrom and off-set with respect to the axis of rotation 48 of the crank shaft 46. The drive member 44 is coupled to the projection 78. An opposite end of the crank shaft 46 is received in a gearbox 80. The motor 42 is coupled to the gearbox 80 for driving the crank shaft 46.

The crimp height adjustment assembly 60 is also supported by the front plate 74 and/or side plates 72. A supporting plate 82 is provided for supporting the adjustment assembly motor 62. Optionally, a plurality of standoffs 84 extend between a top of the front plate 74 and the supporting plate 82 to support the supporting plate 82. A clamp or coupler 86 is used to couple the adjustment assembly motor 62 to a first end 88 of the adjusting mechanism drive shaft 64. A second end 90 of the adjusting mechanism drive shaft 64 is coupled to the adjusting mechanism 56 of the ram assembly 50. Optionally, the second end 90 of the adjusting mechanism drive shaft 64 is received within the adjusting mechanism 56 and the adjusting mechanism 56 is configured to move along the adjusting mechanism drive shaft 64 when the ram assembly 50 moves. In one embodiment, the adjusting mechanism drive shaft 64 is a square shaft such that rotation of the adjusting mechanism drive shaft 64 may be transferred to the adjusting mechanism and rotation with respect to the adjusting mechanism 56 is limited. Alternatively, other shapes may be used for the adjusting mechanism drive shaft 64, such as triangular, hexagonal, oval, or other shapes that transfer torque and limit rotation. Optionally, a holding torque may be applied to the adjusting mechanism drive shaft 64 to hold the position of the adjusting mechanism 56.

During operation of the terminal crimping machine 10, the ram assembly 50 is moved linearly toward and away from the crimping zone 16 with each stroke of the terminator drive system 40. By allowing the ram assembly 50 to move independently with respect to the crimp height adjustment assembly 60, the crimp height adjustment assembly 60 may be fixed with respect to the terminal crimping machine 10. As such, damage and/or wear to the crimp height adjustment assembly 60 due to shock and movement is reduced. However, in alternative embodiments, the crimp height adjustment assembly 60 could be mounted to the ram assembly 50, and move with the ram assembly 50 during each stroke of the terminator drive system 40.

Optionally, the crimp height adjustment assembly 60 includes a sensor 92, such as a linear displacement sensor, coupled to the ram assembly 50 to determine a position of the ram assembly 50. The sensor 92 may provide feedback to the adjustment assembly motor 62, or the sensor may provide feedback to a controller (not shown).

Figure 4:
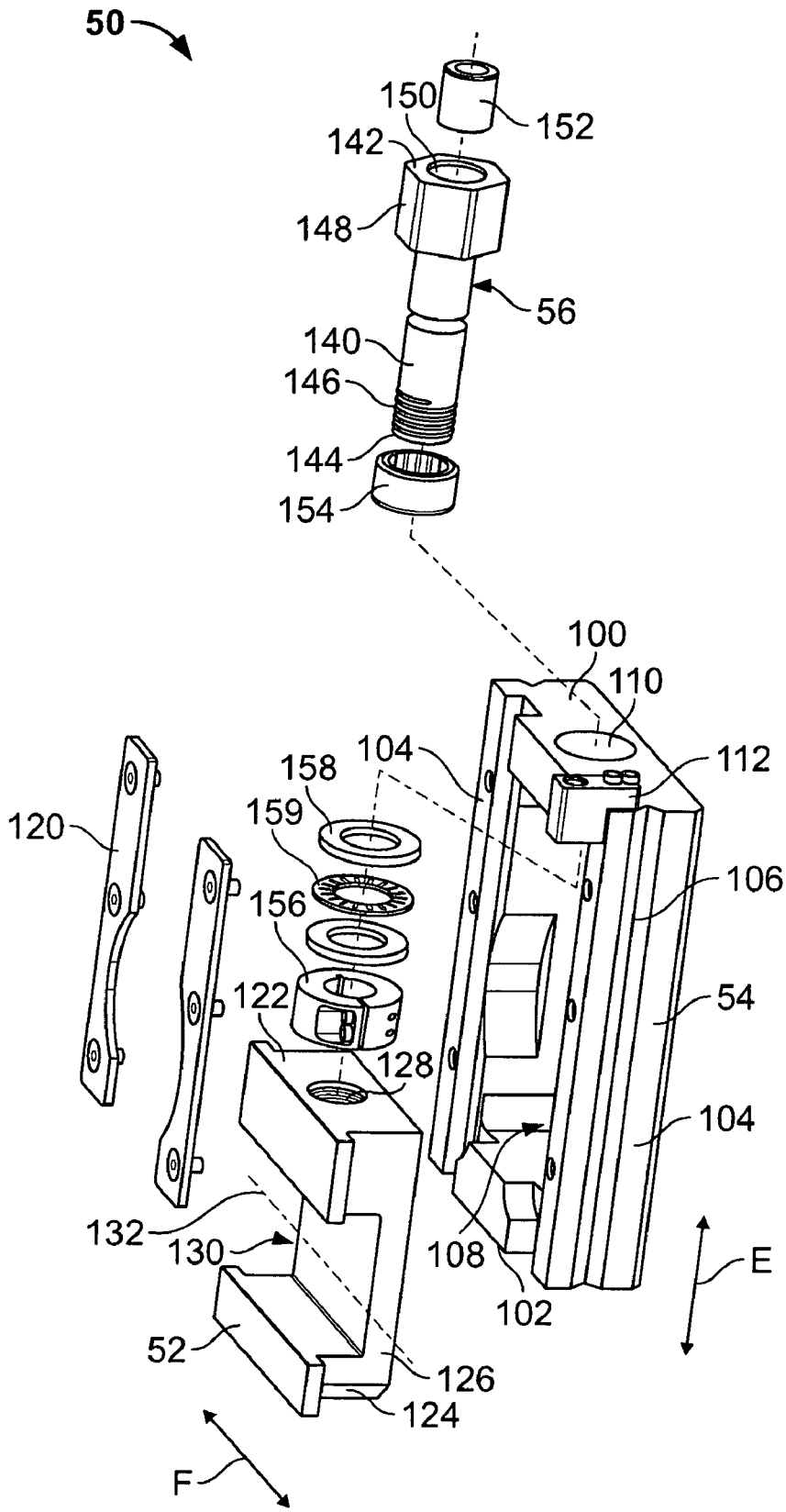
FIG. 4 is an exploded perspective view of an exemplary ram assembly for the terminator assembly shown in FIG. 1.

FIG. 4 is an exploded perspective view of the ram assembly 50 for the terminator assembly 12. The ram assembly 50 includes the inner ram member 52, the outer ram member 54, and the adjusting mechanism 56.

The outer ram member 54 includes a first end wall 100, an opposing second end wall 102 and side walls 104 extending therebetween. The side walls 104 include notched out portions 106 for receiving the rails 75 (shown in FIG. 3). The first end wall 100, the second end wall 102, and the side walls 104 define an outer ram member cavity 108. Optionally, the outer ram member cavity 108 may be open along the back side thereof. However, in an alternative embodiment, the outer ram member 54 may include a back wall extending along the outer ram member cavity 108. The first end wall 100 includes an opening 110 extending therethrough into the outer ram member cavity 108. The opening 110 is substantially centered along the first end wall 100. Optionally, a magnet assembly 112 is coupled to the first end wall 100. The magnet assembly 112 cooperates with the sensor 92 (shown in FIG. 3) for identifying the position of the outer ram member 54 relative to the terminal crimping machine 10, such as, a datum of the terminal crimping machine 10.

The inner ram member 52 is received within the outer ram member cavity 108. Guide plates 120 are used to secure the inner ram member 52 within the outer ram member cavity 108. The guide plates 120 may be used to guide the inner ram member 52 within the outer ram member cavity 108 as the crimp height is being adjusted. For example, as the outer ram member 54 is moved relative to the inner ram member 52, the position of the inner ram member 52 within the outer ram member cavity 108 is changed. The inner ram member 52 generally moves linearly within the outer ram member cavity 108, such as in the direction of arrow E. In an alternative embodiment, rather than having the inner ram member 52 received within the outer ram member 54, the ram members 52 and 54 are arranged in a stacked relationship. For example, the outer ram member 54 may be positioned generally vertically below the inner ram member 52, such as between the inner ram member 52 and the applicator ram 22.

The inner ram member 52 includes a first end wall 122, an opposing second end wall 124 and a side wall 126 extending therebetween. The first end wall includes an opening 128 for receiving the adjusting mechanism 56. Optionally, the opening 128 is threaded. The first end wall 122, the second end wall 124, and the side wall 126 define an inner ram member cavity 130. The inner ram member cavity 130 receives the drive member 44 (shown in FIGS. 1, 2 and 3) when assembled. The inner ram member cavity 130 includes a cavity axis 132 extending along a longitudinal axis of the inner ram member cavity 130. Optionally, the cavity axis 132 is oriented generally perpendicular to the direction of movement (E) of the inner ram member 52 within the outer ram member cavity 108. The inner ram member cavity 130 is sized to allow movement of the drive member 44 within the inner ram member cavity 130. Optionally, the inner ram member cavity 130 is sized to allow linear movement of the drive member 44 within the inner ram member cavity 130 along the cavity axis 132, such as in the direction of arrow F. Arrow F is substantially perpendicular to arrow E.

The adjusting mechanism 56 is received within the opening 110 of the outer ram member 54 and the opening 128 of the inner ram member 52. The adjusting mechanism 56 couples the inner ram member 52 and the outer ram member 54 to one another. As such, the inner ram member 52 and the outer ram member 54 may be moved as a unitary assembly as the terminator drive system 40 is operated. Additionally, the adjusting mechanism 56 may be used to adjust the relative position of the inner ram member 52 with respect to the outer ram member 54. For example, as the adjusting mechanism 56 is rotated, the inner ram member 52 and the outer ram member 54 are moved with respect to one another.

The adjusting mechanism 56 includes a cylindrical body 140 extending between a first end 142 and a second end 144. The cylindrical body 140 includes at least one threaded portion 146 for threadably engaging the inner ram member 52 and/or the outer ram member 54. In one embodiment, the threaded portion 146 is positioned at the second end 144 and engages a correspondingly threaded portion of the opening 128. The cylindrical body 140 includes a head 148 at the first end 142. The head 148 includes an opening 150 extending from the first end 142. Optionally, a bushing 152 is secured within the opening 150. The bushing 152 has a substantially similar cross section as compared to the adjustment mechanism drive shaft 64 (FIG. 3).

During assembly, the inner ram member 52 is positioned within the outer ram member cavity 108. The adjusting mechanism 56 is inserted into the opening 110 of the outer ram member 54. Optionally, a bearing 154 is received within the opening 110 of the outer ram member 54 to facilitate rotation of the adjusting mechanism 56 with respect to the outer ram member 54. A clamp 156 is provided to secure the adjusting mechanism 56 to the outer ram member 54. Optionally, washers 158 and thrust bearing 159 may be positioned between the clamp 156 and the first end wall 100 of the outer ram member 54 in order to reduce turning friction. The second end 144 is then inserted into the opening 128 of the inner ram member 52 and secured thereto by a threaded coupling. In an alternative embodiment, each of the inner and outer ram members 52 and 54, respectively, are secured to the adjusting mechanism 56 by threaded engagement. However, to facilitate adjusting the relative positions of the inner and outer ram members 52 and 54, the threads on each of the inner and outer ram members 52 and 54 have a different pitch or extend in opposite directions.

Figure 5:
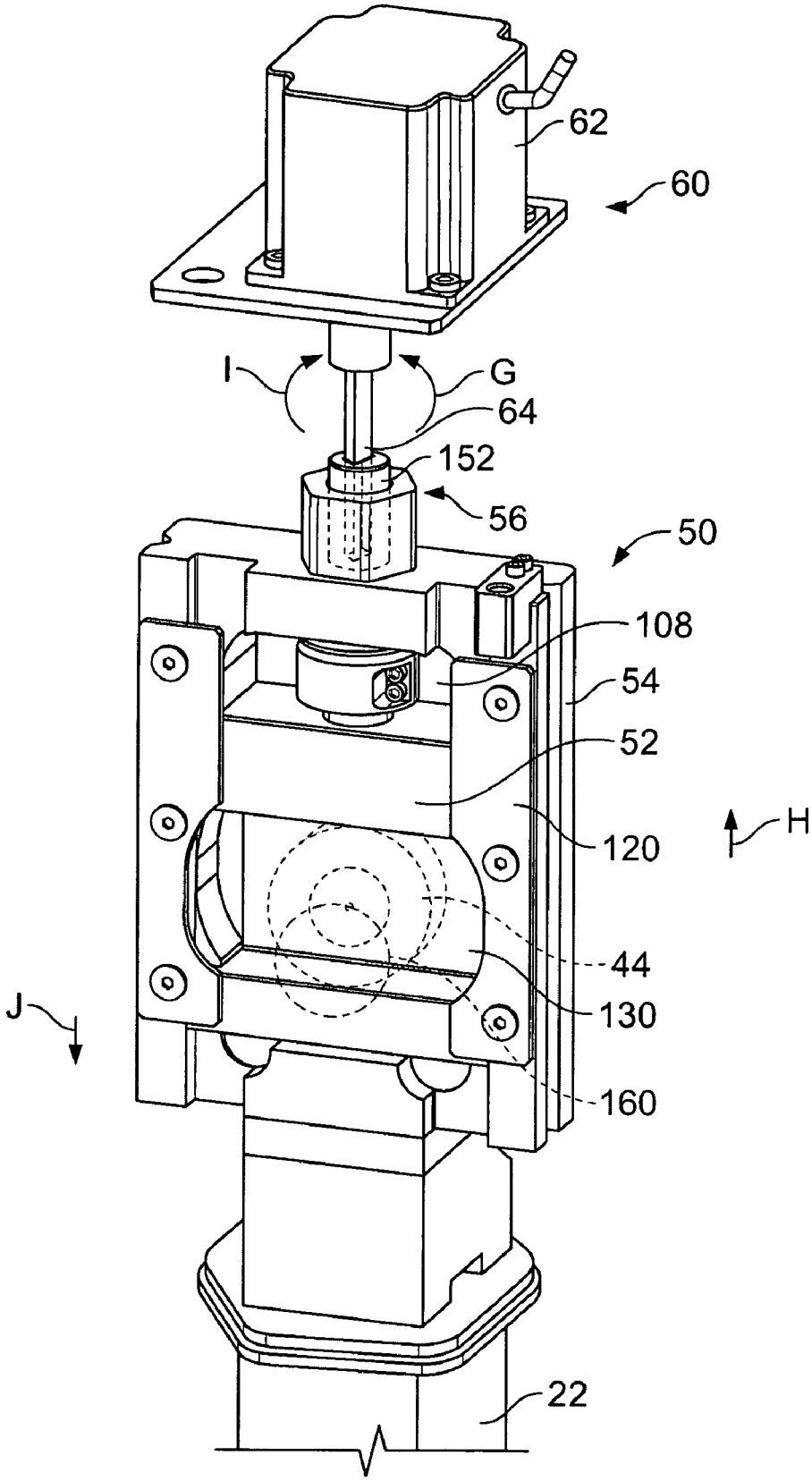
FIG. 5 is an assembled perspective view of the ram assembly shown in FIG. 4 and an exemplary crimp height adjustment assembly.

FIG. 5 is an assembled perspective view of the ram assembly 50 and the crimp height adjustment assembly 60. The inner ram member 52 is positioned within the outer ram member cavity 108. The guide plates 120 secure the inner ram member 52 within the outer ram member cavity 108. The adjusting mechanism 56 couples the inner ram member 52 to the outer ram member 54. The adjusting mechanism drive shaft 64 is received within the bushing 152 such that axes of the adjusting mechanism drive shaft 64 and the adjusting mechanism 56 are substantially aligned. As such, the adjustment assembly motor 62 may directly drive the adjustment mechanism 56 during operation. For example, the adjustment assembly motor 62 rotates the adjusting mechanism drive shaft 64, and the rotation of the adjusting mechanism drive shaft 64 is transferred to the bushing 152 and the adjusting mechanism 56. Because the adjusting mechanism drive shaft 64 is received within the bushing 152, a reliable and durable interconnection may be achieved. Additionally, a lubricant may be added to the adjusting mechanism drive shaft 64 and/or the bushing 152 to facilitate movement between the components.

In operation, rotational movement of the adjusting mechanism 56 changes the relative position of the inner ram member 52 with respect to the outer ram member 54. For example, rotational movement in a counter-clockwise direction, such as in the direction of arrow G, will raise the outer ram member 54, such as in the direction of arrow H, with respect to the inner ram member 52, and thus raise the applicator ram 22. As a result, the crimp height is increased. Alternatively, rotational movement in a clockwise direction, such as in the direction of arrow I, will lower the outer ram member 54, such as in the direction of arrow J, with respect to the inner ram member 52, and thus lower the applicator ram 22. As a result, the crimp height is decreased.

The drive member 44 is shown in phantom. Additionally, an exemplary stroke path is illustrated by reference numeral 160. The horizontal components of the stroke path 160 correspond to movement of the drive member 44 within the inner ram member cavity 130. The inner ram member cavity 130 is sized to restrict vertical movement of the drive member 44 within the inner ram member cavity 130. Rather, the vertical components of the stroke path correspond to vertical movement of the ram assembly 50, including each of the inner and outer ram members 52 and 54, respectively. The vertical movement of the ram assembly 50 facilitates terminating the terminals to the wires. In an exemplary embodiment, the vertical movement of the ram assembly 50 is not transferred to the crimp height adjustment assembly 60. Rather, the ram assembly 50 is moved vertically along the adjusting mechanism drive shaft 64.

A terminal crimping machine 10 is thus provided which controls a crimp height in a cost effective and reliable manner. The terminal crimping machine 10 includes a ram assembly 50 that is adjustable to change the crimp height. A crimp height adjustment assembly 60 is provided to adjust the position of the ram assembly 50, and thus adjust the crimp height. The ram assembly 50 includes an inner ram member 52 and an outer ram member 54. An adjusting mechanism 56 couples the ram members 52 and 54 to one another. The adjusting mechanism 56 is threadably coupled to the inner ram member 52 such that rotation of the adjusting mechanism 56 by the crimp height adjustment assembly 60 changes the relative position of the inner and outer ram members 52 and 54. Because the inner and outer ram members 52 and 54 are moveable with respect to one another, the crimp height may be adjusted in a reliable manner.

While the invention has been described in terms of various specific embodiments, those skilled in the art will recognize that the invention can be practiced with modification within the spirit and scope of the claims.

What is claimed is:

1. A terminator assembly for a terminal crimping machine, said terminator assembly comprising:

a drive member;

a first ram member coupled to the drive member, wherein the drive member moves the first ram member in a first direction toward a crimping zone of the terminal crimping machine, and a second direction away from the crimping zone of the terminal crimping machine;

a second ram member movable with respect to said first ram member to control the crimp height of the terminal crimping machine, said second ram member comprising a base portion configured to engage at least one of an applicator assembly and crimp-tooling;

an adjusting mechanism coupled to each of said first and second ram members, said adjusting mechanism configured to adjust a relative position of said first ram member with respect to said second ram member; and a motor operatively coupled to a drive shaft, said drive shaft engaging said adjusting mechanism for driving said adjusting mechanism.

2. The terminator assembly of claim 1, wherein said second ram member comprises a second ram member cavity, said first ram member received within said second ram member cavity.

3. The terminator assembly of claim 1, wherein said adjusting mechanism comprises a threaded portion, said threaded portion engages at least one of said first and second ram members, wherein rotational movement of said adjusting mechanism changes the relative position of said first ram member with respect to said second ram member.

4. The terminator assembly of claim 1, wherein said drive shaft comprises a drive shaft axis and said adjusting mechanism comprises an adjusting mechanism axis, said drive shaft axis substantially aligned with said adjusting mechanism axis.

5. The terminator assembly of claim 1, wherein said adjusting mechanism comprises an opening at an end thereof, said drive shaft received within said opening for driving said adjusting mechanism and said adjusting mechanism being moved linearly along said drive shaft as said first ram member is moved in the first and second directions.

6. The terminator assembly of claim 1, wherein said drive shaft comprises a keying feature for transferring rotational movement of said drive shaft to said adjusting mechanism.

7. The terminator assembly of claim 1, wherein said drive member is coupled to a crank shaft, said drive member offset with respect to an axis of rotation of the crank shaft, wherein said drive member orbits the axis of rotation during rotation of said crank shaft.

8. The terminator assembly of claim 7, wherein said first ram member comprises a first ram member cavity having a cavity axis, said drive member received within said first ram member cavity and movable along the cavity axis.

9. The terminator assembly of claim 8, wherein each of said first ram member and said second ram member are movable in a linear direction substantially perpendicular to the cavity axis when said drive member orbits the axis of rotation.

10. The terminator assembly of claim 1, wherein said adjusting mechanism is movable away from and toward said motor as said first ram member is moved along said first and second directions, respectively.

11. A terminator assembly for a terminal crimping machine, said terminator assembly comprising:

a drive member configured to be coupled to a crank shaft that rotates about an axis of rotation such that the drive member is off-set with respect to the axis of rotation of the crank shaft and such that the drive shaft orbits the axis of rotation during rotation of the crank shaft;

a first ram member coupled to the drive member, wherein the drive member moves the first ram member in a first direction toward a crimping zone of the terminal crimping machine, and a second direction away from the crimping zone of the terminal crimping machine;

a second ram member comprising a second ram member cavity, said first ram member received within said second ram member cavity, said second ram member movable with respect to said first ram member to control the crimp height of the terminal crimping machine, said second ram member comprising a base portion configured to engage at least one of an applicator assembly and crimp-tooling; and an adjusting mechanism coupled to each of said first and second ram members, said adjusting mechanism configured to adjust a relative position of said first ram member with respect to said second ram member.

12. The terminal crimping machine of claim 11, wherein said adjusting mechanism comprises a threaded portion, said threaded portion engages at least one of said first and second ram members, wherein rotational movement of said adjusting mechanism changes the relative position of said first ram member with respect to said second ram member.

13. The terminal crimping machine of claim 11, wherein said adjusting mechanism is operatively coupled to a motor for driving said adjusting mechanism, said motor operated independently with respect to said drive member.

14. The terminal crimping machine of claim 11, wherein said first ram member comprises a first ram member cavity having a cavity axis, said drive member received within said first ram member cavity and movable along the cavity axis.

15. The terminal crimping machine of claim 14, wherein each of said first ram member and said second ram member are movable in a linear direction substantially perpendicular to the cavity axis when said drive member orbits the axis of rotation.

16. The terminal crimping machine of claim 11, wherein said drive member is configured to move said first ram member and said second ram member unitarily in a first direction toward a crimping zone, and a second direction away from the crimping zone.

17. The terminal crimping machine of claim 11, wherein said adjusting mechanism is configured to move said second ram member with respect to said first ram member in a first direction toward a crimping zone, and a second direction away from the crimping zone.

18. A crimp height adjustment assembly for adjusting a crimp height of a terminal crimping machine, said crimp height adjustment assembly comprising:

a first ram member configured to be coupled to a drive member of the terminal crimping machine, wherein the drive member moves the first ram member in a first direction toward a crimping zone of the terminal crimping machine, and a second direction away from the crimping zone of the terminal crimping machine;

a second ram member movable with respect to said first ram member to control the crimp height of the terminal crimping machine, said second ram member comprising a base portion configured to engage at least one of an applicator assembly and crimp-tooling;

an adjusting mechanism coupled to each of said first and second ram members, said adjusting mechanism extending along an adjusting mechanism axis that is parallel to the first and second directions of movement of said first ram member, said adjusting mechanism configured to adjust a relative position of said first ram member with respect to said second ram member along said adjusting mechanism axis; and a motor operatively coupled to a drive shaft, said drive shaft engaging said adjusting mechanism for driving said adjusting mechanism.

19. The crimp height adjustment assembly of claim 18, wherein said second ram member comprises a second ram member cavity, said first ram member received within said second ram member cavity.

20. The crimp height adjustment assembly of claim 18, wherein said adjusting mechanism comprises an opening at an end thereof, said drive shaft received within said opening for driving said adjusting mechanism.

* * * * *